United States Patent [19]

Frigiere

[11] Patent Number: 5,044,936

[45] Date of Patent: Sep. 3, 1991

[54] GASEOUS FUEL SUPPLYING MEANS OF AN APPARATUS USING THE COMBUSTION OF THIS GAS STORED IN THE LIQUID PHASE

[75] Inventor: Rene Frigiere, Charbonnieres Les Bains, France

[73] Assignee: Feudor S. A., Rillieux La Pape, France

[21] Appl. No.: 578,732

[22] Filed: Sep. 6, 1990

[30] Foreign Application Priority Data

Sep. 21, 1989 [FR] France ..... 89 13224

[51] Int. Cl.[5] ..... F23D 14/28

[52] U.S. Cl. ..... 431/344; 126/403; 126/408; 126/414

[58] Field of Search ..... 431/344; 126/403, 406, 126/407, 408, 409, 414; 222/3

[56] References Cited

U.S. PATENT DOCUMENTS

| | | | |
|---|---|---|---|
| 4,101,262 | 7/1978 | Neyret | 431/344 |
| 4,478,570 | 10/1984 | Johansson | 431/344 |
| 4,641,632 | 2/1987 | Nakajima | 126/406 |
| 4,929,176 | 5/1990 | Nitta | 431/344 |

*Primary Examiner*—Carroll B. Dority

*Attorney, Agent, or Firm*—Herbert Dubno

[57] ABSTRACT

An apparatus which is heated by a gasified liquid fuel has between the liquid fuel reservoir and a burner, a flow regulator/evaporator consisting of two porous masses separated by a recondensation chamber, the valve for cutting off the combustion being provided between the burner and the downstream mass. Liquid fuel can accumulate in the recondensation chamber so that, for startup of the system, there is an increased flow of fuel through the downstream porous mass to the burner to allow rapid heat up of the heat-distributing member. After the initial heating period the flow to the burner is determined by the porosity characteristics of both masses in series.

2 Claims, 1 Drawing Sheet

GASEOUS FUEL SUPPLYING MEANS OF AN APPARATUS USING THE COMBUSTION OF THIS GAS STORED IN THE LIQUID PHASE

FIELD OF THE INVENTION

The present invention relates to gaseous fuel supplying means of an apparatus using the combustion of this gas stored in the liquid phase.

BACKGROUND OF THE INVENTION

Curling tongs, soldering irons, electric irons, hair dryers and coffee machines may be mentioned, in particular, as apparatuses which can use gas combustion as the heating source. In these apparatuses, there is provided a reservoir containing the combustible gas, in most cases in the liquid phase, a flow regulator-/evaporator which guarantees a constant flow of fuel in the gaseous phase, an igniting device and a heat-distributing member permitting optimum utilization of the thermal energy coming from the combustion of the gas/atmospheric oxygen mixture. The presence of the regulator/evaporator, which generally consists of a porous mass whose permeability determines the gas flow, is intended not only to guarantee that the fuel will reach the burner in the gaseous state, but also to limit the flow to a value such that the combustion generates, in the heat-distributing member, an average temperature situated between two limiting values, a lower limit corresponding to the operating threshold of the apparatus and an upper limit beyond which this operation would be dangerous.

The thermal phenomena are generally relatively slow to develop and stabilize, mainly due to the thermal inertia of the constituent elements of the heat-distributing member, each of which has a considerable specific heat, and also due to the size of the heat losses through convection and conduction.

As a result, a not insignificant length of time is necessary for the heat-distributing member to reach the minimum operating temperature.

This time could be reduced by increasing the gas flow, but this would also lead to a rise in the average temperature of the heat-distributing member, which could result in an operating temperature above the maximum safe temperature.

OBJECTS OF THE INVENTION

The object of the present invention is to overcome this disadvantage by permitting a rapid temperature rise of the heat-distributing member without this resulting, however, in an increase in the normal operating temperature.

SUMMARY OF THE INVENTION

To this end, in the means to which the invention relates and which are of the type comprising a flow regulator/evaporator consisting of at least one porous mass arranged between the reservoir in which the fuel is stored in the liquid phase and the burner with which an igniting device is associated and which is intended for producing the gaseous-phase fuel/combustion air mixture supplying a flame, and a heat-distributing member maintained by the flame at a temperature situated between two limiting values, one an operating threshold limit and the other a safety limit, a closing/opening flap valve being arranged upstream of the burner, on the one hand, the flow regulator/evaporator consists of two porous masses whose permeabilities are such that the sum of the pressure losses which they generate is equal to the pressure loss corresponding to the desired flow for normal operation of the apparatus and which are separated from one another by a recondensation chamber whose volume corresponds to the quantity of fuel necessary for the heat-distributing member to reach its normal operating temperature, whereas the porosity of the second porous mass is fixed as a function of the fuel flow corresponding to the desired duration for this temperature rise and, on the other hand, the flap valve is arranged between the flow regulator/evaporator and the burner.

According to an advantageous embodiment of the invention, the recondensation chamber is provided with means permitting adjustment of its volume as a function of the calorific requirements of the heat-distributing member in order to reach its normal operating temperature.

According to another advantageous feature of the invention, all the elements which make up the flow regulator/evaporator are inserted in the wall of the fuel reservoir.

BRIEF DESCRIPTION OF THE DRAWINGS

In any event, the invention will be clearly understood with aid of the description which follows, with reference to the attached schematic drawing showing an embodiment of the combustible gas supplying means. In the drawing and illustrating the functioning of these means.

DESCRIPTION

Figure 1:
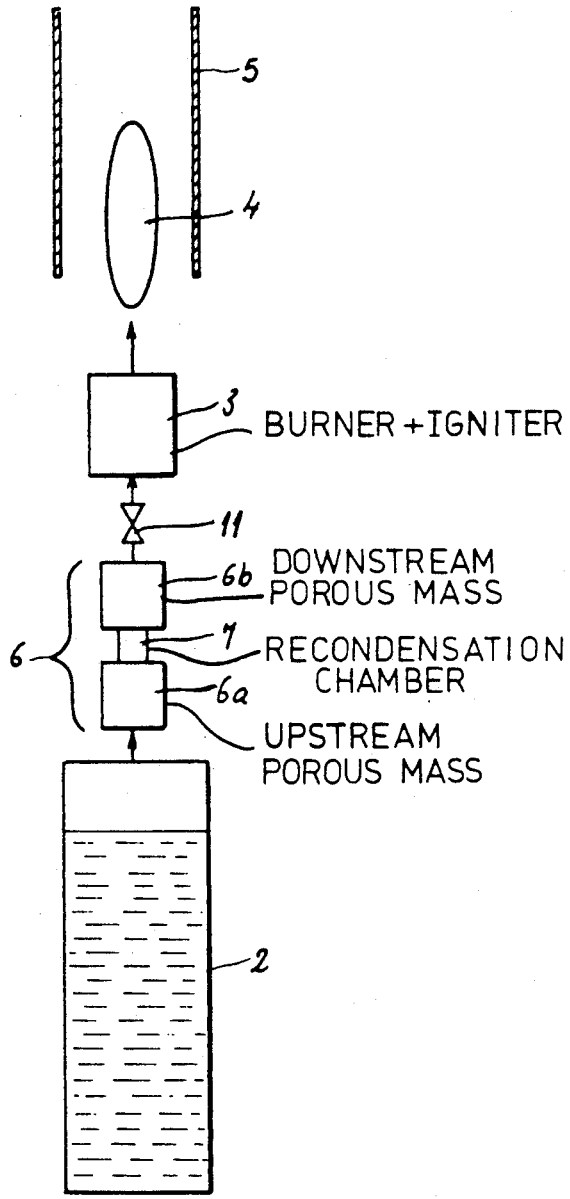
FIG. 1 is a side elevational view showing, highly schematically, an apparatus using gas combustion and equipped with gas-supplying means according to the invention.

The apparatus of FIG. 1 is of the type comprising a reservoir 2 in which the gaseous fuel is stored in the liquid phase, a burner 3 intended for receiving the fuel in a gaseous phase coming from the reservoir 2 and for mixing it with combustion air in order to generate a flame 4, or any form of combustion of this gas, in the vicinity of which a heat-distributing member 5 is arranged.

Arranged between the reservoir 2 and the burner 3 is a flow regulator/evaporator 6 whose presence is intended not only to guarantee the passage in the gaseous phase of the fuel coming from the reservoir 2, before it reaches the burner 3, but also to limit the gas flow which supplies the flame 4 to a value situated between two limiting values, a lower limit corresponding to the operating threshold of the apparatus and an upper limit constituting a limiting safety value beyond which this operation would be dangerous. Finally, there is provided, between the flow regulator/evaporator 6 and the burner 3, a flap valve 11, making it possible to extinguish the flame 4 by cutting off the flow of fuel in the gaseous phase.

As shown in FIG. 1, the flow regulator/evaporator 6 of the supplying means according to the invention consists of two porous masses 6*a*, 6*b* arranged one after the other with provision, therebetween, of a chamber 7 known as a recondensation chamber.

In order to prevent the temperature of the heat-distributing member 5 from exceeding the maximum safe value, the two porous masses 6a and 6b are chosen with an inherent porosity such that the sum of the pressure losses which they generate is equal to the pressure loss which corresponds to the gas flow required to maintain to an average temperature of the heat-distributing member 5 situated between the two limiting values mentioned above. The separation of the flow regulator-/evaporator into two independent porous masses 6a, 6b has no effect, therefore, on the normal operation of the apparatus. In contrast, this separation necessarily has the effect that the porous mass 6b situated downstream of the other has a permeability greater than the sum of the permeabilities of the two masses 6a, 6b, one which the flow regulator/evaporator would have to possess if it were not separated into two. The result is, therefore, that the flow, through this second porous mass 6b, of the fuel stored in the recondensation chamber 7, is much greater than the average flow passing through the two masses 6a, 6b during normal operation of the apparatus. The presence of this recondensation chamber 7 arranged between the two porous masses 6a, 6b therefore clearly has the effect of creating, when the apparatus is turned on, a transitional operating mode, during which the gas flow will be much greater than the flow of the normal operating mode (corresponding to the flow of the stored fuel in the recondensation chamber through the mass 6b). This high-flow transitional operating mode therefore permits a much more rapid temperature rise of the heat-distributing member 5 than if the recondensation chamber 7 did not exist.

Of course, to assume that the maximum safe temperature of the heat-distributing member 5 is never exceeded, the quantity of fuel stored in the recondensation chamber 7 must not exceed the quantity required for raising the temperature of the heat-distributing member to a value below the limiting safety temperature. The volume of the recondensation chamber 7 is therefore determined by this required quantity of fuel but it is advantageously adjustable.

Moreover, the time required for the passage, through the second porous mass 6b, of the quantity of fuel stored in the recondensation chamber 7 and which is a function of the permeability of the porous mass 6b, determines the time required for the heat-distributing member 5 to reach its normal operating temperature.

Figure 2:
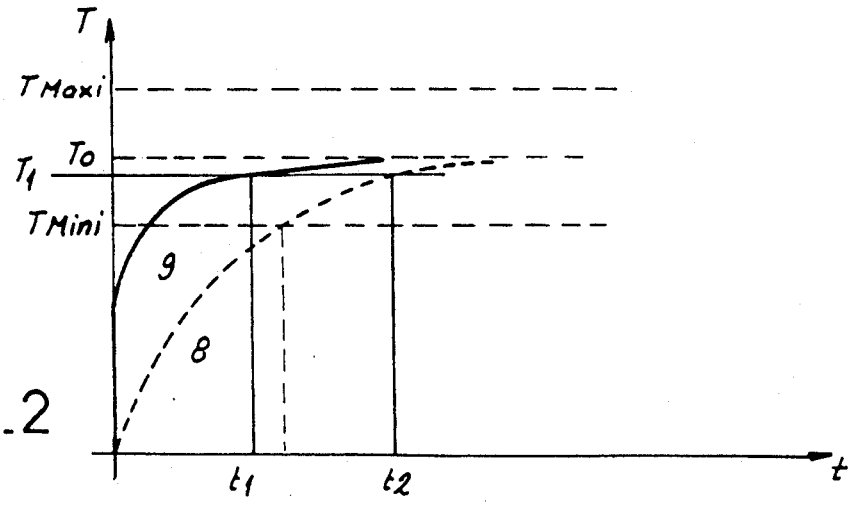
FIG. 2 is a graph which shows the characteristic curve of the apparatus of FIG. 1 in comparison with the characteristic curve of a similar apparatus which is not equipped with the supplying means according to the invention.

FIG. 2 shows two curves, one curve 8, illustrating the operation of a conventional type of gaseous fuel supplying means and the other curve 9, illustrating the operation of the gaseous fuel supplying means according to the invention.

In this FIG. 2, the times are plotted as abscissae and the temperatures as ordinates. The two curves 8 and 9 correspond to normal operating flow rates permitting maintenance, during this normal operation, of the heat-distributing member 5 at an average temperature situated between the minimum operating threshold temperature mini of the apparatus and the maximum temperature maxi beyond which the operation of this apparatus would be dangerous.

The curve 8, which illustrates the operation of supplying corresponding to a constant flow not preceded transitional operating mode of accelerated flow, shows that a time t2 is necessary for the heat-distributing member to reach a temperature T1, whereas the curve 9, which corresponds to an operation in which the normal steady operating mode is preceded by an operating mode with accelerated flow, shows that a time t1 is necessary in order to reach this same temperature T1. By comparing the curves 8 and 9 it can be seen, in addition, that the time t1 is substantially half the time t2.

In steady operating mode, that is to say after the transitional operating mode, the recondensation chamber 7 is filled with fuel in the gaseous state and at an intermediate pressure between the gas vapor pressure at the temperature of the apparatus and atmospheric pressure, the porous mass 6a, of the flow regulator/evaporator 6, arranged upstream ensuring a flow of fuel exclusively in the gaseous phase. This intermediate pressure depends on the respective values of the permeabilities of two porous masses 6a and 6b of the flow regulator-/evaporator 6.

When turned off, that is to say when the gas flow is zero at the outlet of the porous mass 6b situated downstream, a condensation of the fuel takes place within the recondensation chamber which is brought about by the search for equilibrium between, on the one hand, the pressure which prevails upstream of the porous mass 6a of the flow regulator/evaporator 6, situated upstream, that is to say between the pressure which prevails in the reservoir 2 and which corresponds to the vapor pressure of the fuel present in the liquid phase and, on the other hand, that which prevails downstream of the porous mass 6a, that is to say in the recondensation chamber 7. This equilibrium-searching phenomenon is relatively lengthy since the transfer of mass through the porous mass 6a of the regulator 6 is effected by capillarity phenomena within a mesoporous medium. During this time, the heat-distributing member 5 cools down.

As soon as the first drop of condensate appears inside the recondensation chamber 7, the pressure inside this chamber becomes equal to the fuel vapor pressure. Eventually, this chamber 7 fills entirely with liquid condensate.

When the apparatus is turned on again, the instantaneous flow through the downstream element 6b of the flow regulator/evaporator 6 is obviously markedly higher than the normal operating flow since the pressure in the recondensation chamber 7 is now equal to the fuel vapor pressure.

If, for example, the permeabilities of the porous masses 6a and 6b of the regulator 6 are equal and consequently if these individual permeabilities are equal to twice the collective permeability corresponding to the normal operating flow, the flow corresponding to the transitional operating mode through only the mass 6b will be twice that corresponding to the normal operating mode.

Of course, the duration of the transitional operating mode is a function, on the one hand, of the volume of the recondensation chamber and, on the other hand, of the permeability of the porous mass 6b situated downstream. Theoretically, as long as there is a single drop of condensate in this recondensation chamber 7, the transitional operating mode persists with a flow which is accelerated by the high value of the pressure in this recondensation chamber 7. In practice, the evaporation rate can be limited in time by the weakness of the liquid-vapor interface inside the recondensation chamber 7, reducing the pressure to a value below the fuel vapor pressure, but this in no way changes this acceleration effect of the flow during the transitional operating mode.

The increase of the fuel flow during the transitional period therefore obviously has the effect of accelerating the heating of the heat-distributing member in such a way that this member reaches its normal operating temperature more rapidly without, however, this temperature being able to exceed the maximum safe operating temperature of the apparatus, since the transitional operating mode with accelerated fuel flow stops when any trace of fuel in the liquid phase has disappeared from the recondensation chamber 7.

According to a simple embodiment of the invention, each porous mass 6*a*, 6*b* of the regulator 6 consists of a mesoporous membrane.

An interesting feature of the operation of the combustible gas supplying means according to the invention should also be noted. In effect, for safety reasons which are easy to understand, it is necessary that, when the heat-distributing member 5 has reached its optimum operating temperature and the gas supply is cut off, the thermal inertia of this heat-distributing member 5 does not permit its instantaneous return to ambient temperature. If, within a relatively short time compared with this total cooling time of the heat-distributing member 5, the fuel-supplying means are again ignited, it is essential that the transitional operating mode with accelerated gas flow is not able to intervene or, if it intervenes, it is absolutely essential that it is able to operate only for a very short time so as to prevent heat being supplied to the still hot heat-distributing member 5 from causing the maximum safe temperature to be exceeded. The slowness of the recondensation phenomenon by mass transfer within the porous medium constituting the upstream mass 6*a* of the flow regulator/evaporator 6 makes it possible to avoid such a risk. In fact, the heat-distributing member 5 will have reached ambient temperature before the first drops of liquid fuel have formed in the recondensation chamber 7, since, upon interruption of the gas flow, the pressure in this chamber 7 was at a value below the vapor pressure which prevails in the main reservoir 2. The phenomenon of mass transfer in the porous medium of the upstream porous mass 6*a* of the regulator 6 will first have to ensure that the pressure of the recondensation chamber returns to the vapor pressure before the recondensation actually starts.

I claim:

1. A gaseous fuel supply device for an apparatus using combustion of a gas fuel stored in a liquid phase, comprising:

a flow regulator/evaporator;

a reservoir upstream of said flow regulator/evaporator in which the fuel is stored in the liquid phase;

a burner associated with an igniting device downstream of said flow regulator/evaporator for producing a gaseous-phase fuel/combustion air mixture supplying combustion for heating said apparatus;

a heat-distributing member maintained by this combustion at a temperature situated between two limiting values, one an operating threshold limit and the other a safety limit; and a closing/opening flap valve between said flow regulator/evaporator and said burner, the flow regulator/evaporator consisting of two multicapillary porous masses comprising mesoporous membranes whose permeabilities are such that the sum of the pressure losses which they generate is equal to a pressure loss corresponding to a desired flow for normal operation of the apparatus and which are separated from one another by a recondensation chamber whose volume corresponds to the quantity of fuel required for a rapid temperature rise of the heat-distributing member to its normal operating temperature, the porosity of the second of said mass downstream of said chamber being fixed as a function of the fuel flow corresponding to a desired duration for said temperature rise.

2. The device as claimed in claim 1 wherein the flow regulator/evaporator is inserted in a wall of the fuel reservoir.

* * * * *